United States Patent [19]

El Sherif et al.

[11] 4,150,686

[45] Apr. 24, 1979

[54] ELECTROHYDRAULIC CONTROL MODULE

[75] Inventors: Fouad El Sherif, Valencia; Harry J. Svoboda, Granada Hills, both of Calif.

[73] Assignee: Textron Inc., Providence, R.I.

[21] Appl. No.: 742,291

[22] Filed: Nov. 15, 1976

[51] Int. Cl.[2] ..... F15B 13/043

[52] U.S. Cl. ..... 137/377; 137/596.16; 137/625.64; 91/459; 91/363 A

[58] Field of Search ..... 137/625.64, 596.16, 137/269, 377; 251/368; 91/459, 363 A

[56] References Cited

U.S. PATENT DOCUMENTS

| | | | |
|---|---|---|---|
| 2,823,689 | 2/1958 | Healy | 137/625.64 |
| 2,981,287 | 4/1961 | Caslow | 137/625.64 |
| 3,034,483 | 5/1962 | Rasmussen | 137/625.64 |
| 3,874,405 | 4/1975 | Thayer | 138/625.64 |

FOREIGN PATENT DOCUMENTS

| | | | |
|---|---|---|---|
| 1221451 | 2/1971 | United Kingdom | 91/363 A |

*Primary Examiner*—Martin P. Schwadron
*Assistant Examiner*—A. Michael Chambers
*Attorney, Agent, or Firm*—Nilsson, Robbins, Dalgarn, Berliner, Carson & Wurst

[57] ABSTRACT

A modular control device which may be used separately or in predetermined multiples to provide desired detection and correction functions along with appropriate control functions normally associated with current day aircraft flight control. The module includes a housing which makes provisions for a plurality of bores capable of receiving various types of valve mechanisms therein. Control valves such as a servovalve and a solenoid valve are affixed to the housing and are hydraulically interconnected with the valves disposed in the various bores. The module may be connected to a hydraulic actuator which is moved to in turn position a load in accordance with control signals applied to the control module.

8 Claims, 7 Drawing Figures

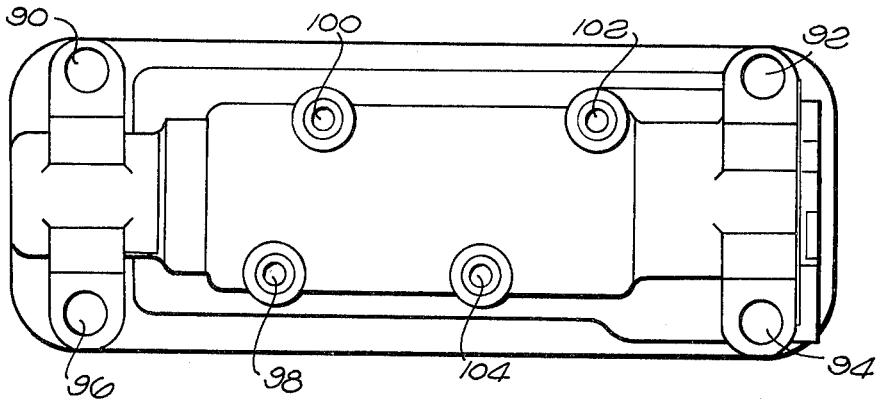
FIG. 6
FIG. 7
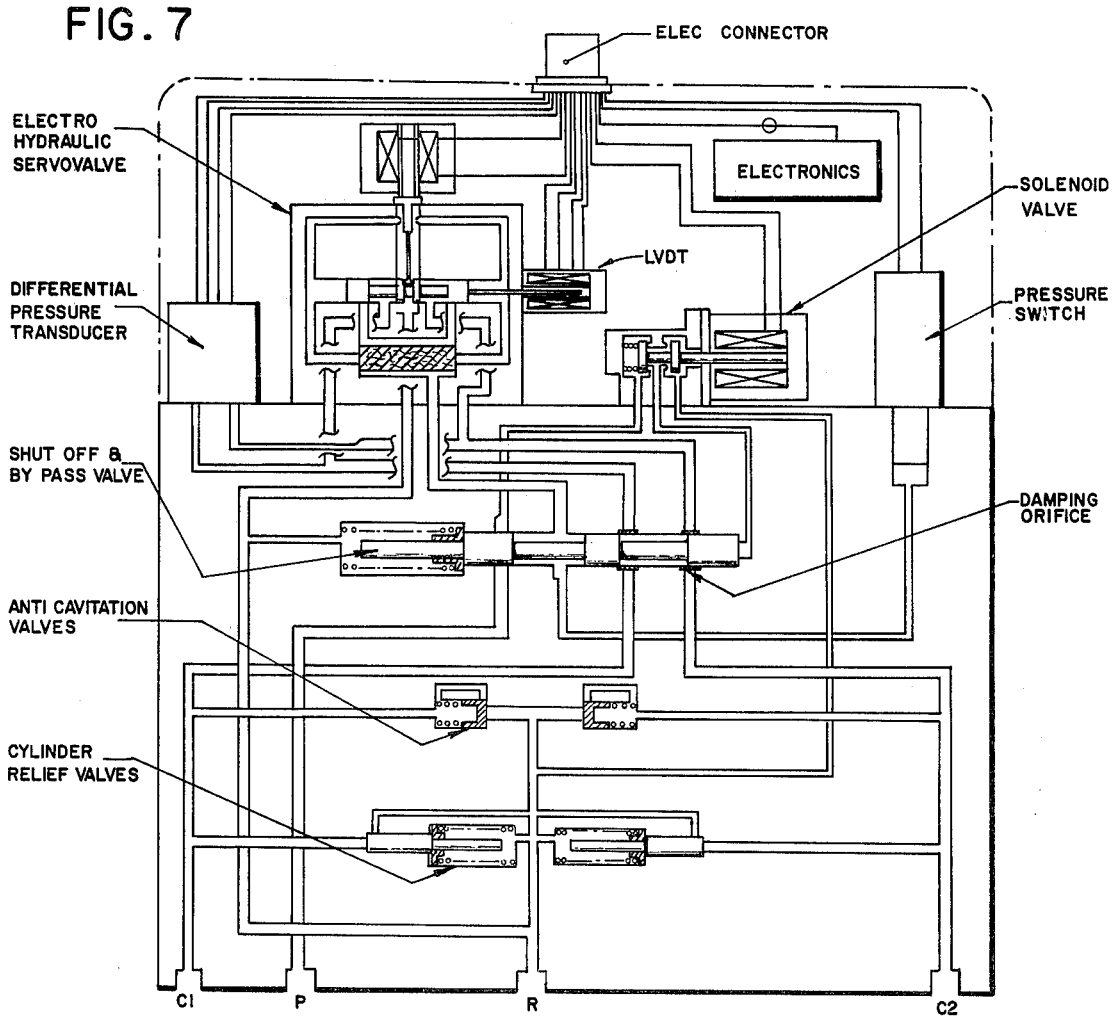

ELECTROHYDRAULIC CONTROL MODULE

BACKGROUND OF THE INVENTION

Aircraft control systems as currently in use particularly on more sophisticated and/or high speed aircraft range from the relatively simple single channel control system to the very complex redundant double fail operate-fail safe quadruplex systems offering continued operation even in the case of failure of one or more control channels. These control systems may be of the fly-by-wire type or of the pseudo fly-by-wire types utilizing hydromechanical logic or electrical logic for failure detection and correction. In almost all cases, the flight control system utilized contains some type of control augmentation system or stability augmentation system as a source of input control signals thereto. In addition thereto, the control system also generates feedback signals which must be utilized in properly controlling the aircraft. Therefore, the overall control system must be capable of receiving and handling various types of input and feedback signals.

Prior art systems of the foregoing type have required that each of the systems be specifically designed and developed to meet the particular requirements of the aircraft and the aircraft control system contemplated by the manufacturer. It is usually also required that each of the components which is to go into the control detection correction system be custom designed for the specific aircraft under consideration. Obviously, such custom design and manufacturing of each individual system requires the expenditure of substantial non-recurring engineering costs and manufacturing costs for each particular design and development of each particular system.

In these prior art systems, it is also necessary for each of the various component parts of the system to be electrically, mechanically and hydraulically interconnected in order to provide the desired operation for which the system has been designed. Such interconnection of the various component parts of the system sometimes creates interfacing problems when a transition occurs from electrical to mechanical or mechanical to hydraulic or electrical to hydraulic or the like within the system. Such interconnection and possible interfacing problems may also result in both short-term and long-term reliability problems. It will be obvious to those skilled in the art that, by custom designing each of the control systems for each of the aircraft as they are designed, the short-term and long-term reliability is dependent upon the particular design employed in that particular aircraft and must be approached individually as a separate problem for each of the new custom designed systems manufactured for each of the aircraft.

These prior art systems also necessitate complicated maintenance requirements, each tailored for the specific system and specific aircraft under consideration. Such complicated maintenance requirements may often result in relatively long down-time periods for the aircraft under consideration to permit the appropriate isolation of the problem and correction thereof when the same occurs on the particular control system that has been specifically designed for the aircraft under consideration.

SUMMARY OF THE INVENTION

An electrohydraulic control device which includes a unitary housing member defining a plurality of bores therein and having at least one electrically operated hydraulic valve member component affixed to the housing. At least one hydraulically actuated slide valve member component is disposed within each of the bores defined by the housing member. The housing member also defines a plurality of fluid passageways interconnecting each of the components disposed therein with others of said components. The housing further defines ports for receiving pressure and return connections and for connecting working fluid to a load apparatus.

BRIEF DESCRIPTION OF THE DRAWINGS

FIG. 6 is a bottom view of the structure shown in FIG. 3 illustrating the mounting hole and port configuration thereof; and FIG. 7 is a hydraulic schematic diagram showing one form which a modular electrohydraulic control apparatus constructed in accordance with the present invention may take.

DETAILED DESCRIPTION OF THE PREFERRED EMBODIMENT

Figure 1:
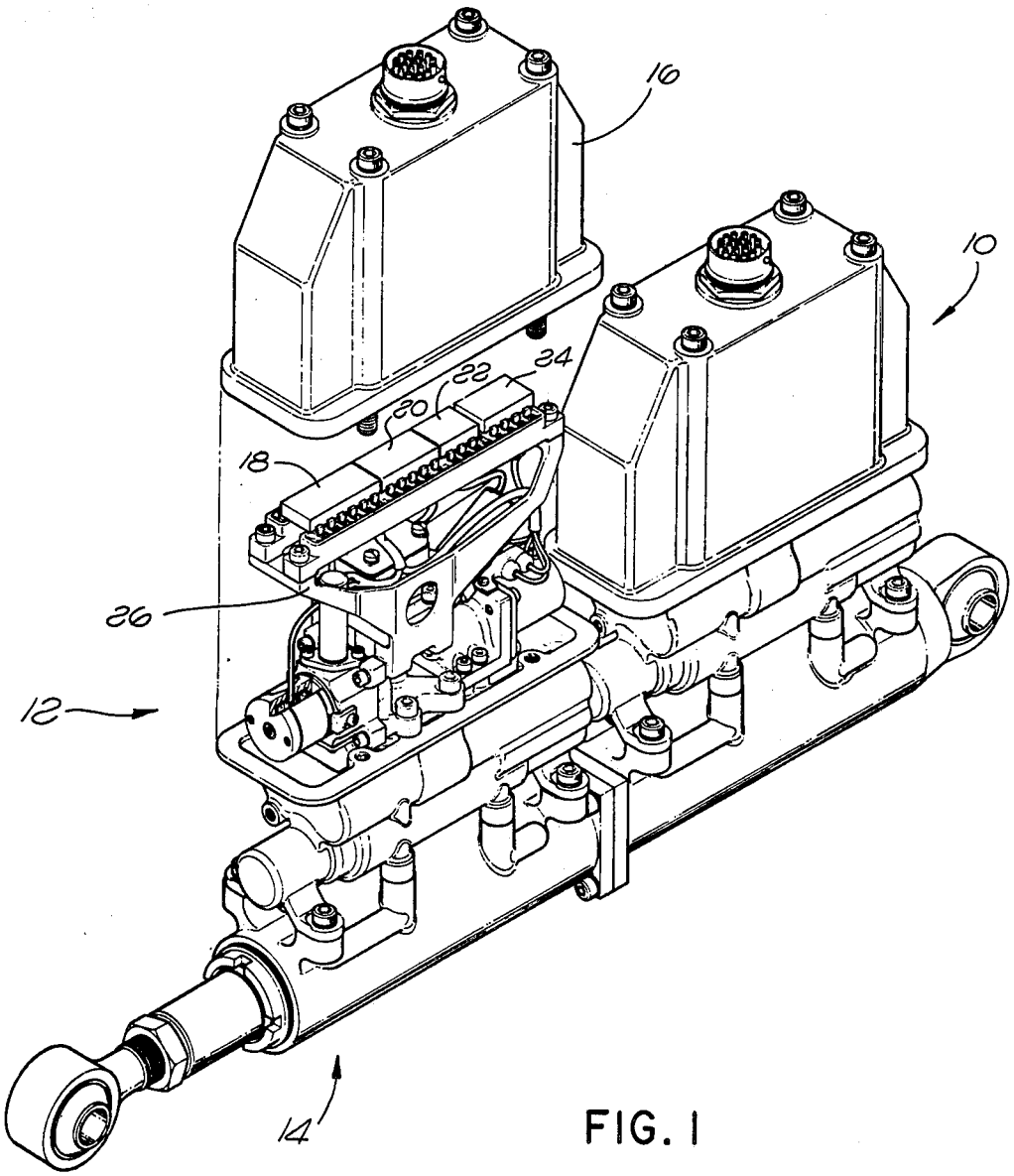
FIG. 1 is a perspective view, partially exploded, illustrating two modular electrohydraulic control devices constructed in accordance with the present invention attached to a control actuator.

As is illustrated particularly in FIG. 1 a modular electrohydraulic control apparatus 10 and 12 (hereinafter MECA) constructed in accordance with the present invention may be attached to a hydraulic control actuator 14. Those skilled in the art will recognize that the actuator 14 may be affixed to various apparatus such as aircraft control surfaces, nose wheel steering, engine control, helicopter rotors and the like depending upon the particular application. FIG. 1 shows a dual-tandem actuator configuration thus requiring two MECA 10 and 12 each attached to one actuator. Obviously, depending on the particular application, only one MECA may be used or more than two MECA may be used.

The cover 16 on the MECA 12 is shown removed thereby to illustrate the placement of various portions of the MECA. Various Large Scale Integrated (LSI) hybrid components 18, 20, 22 and 24 contain electronics associated with the control functions of the MECA, for example, a demodulator, servoamplifier, differential pressure electronics, a power supply and the like. The components 18–24 are mounted upon a frame 26 secured to other structure within the MECA. The frame 26 may operate as a heat sink to remove heat which may otherwise affect operation of the electronic components.

Figure 2:
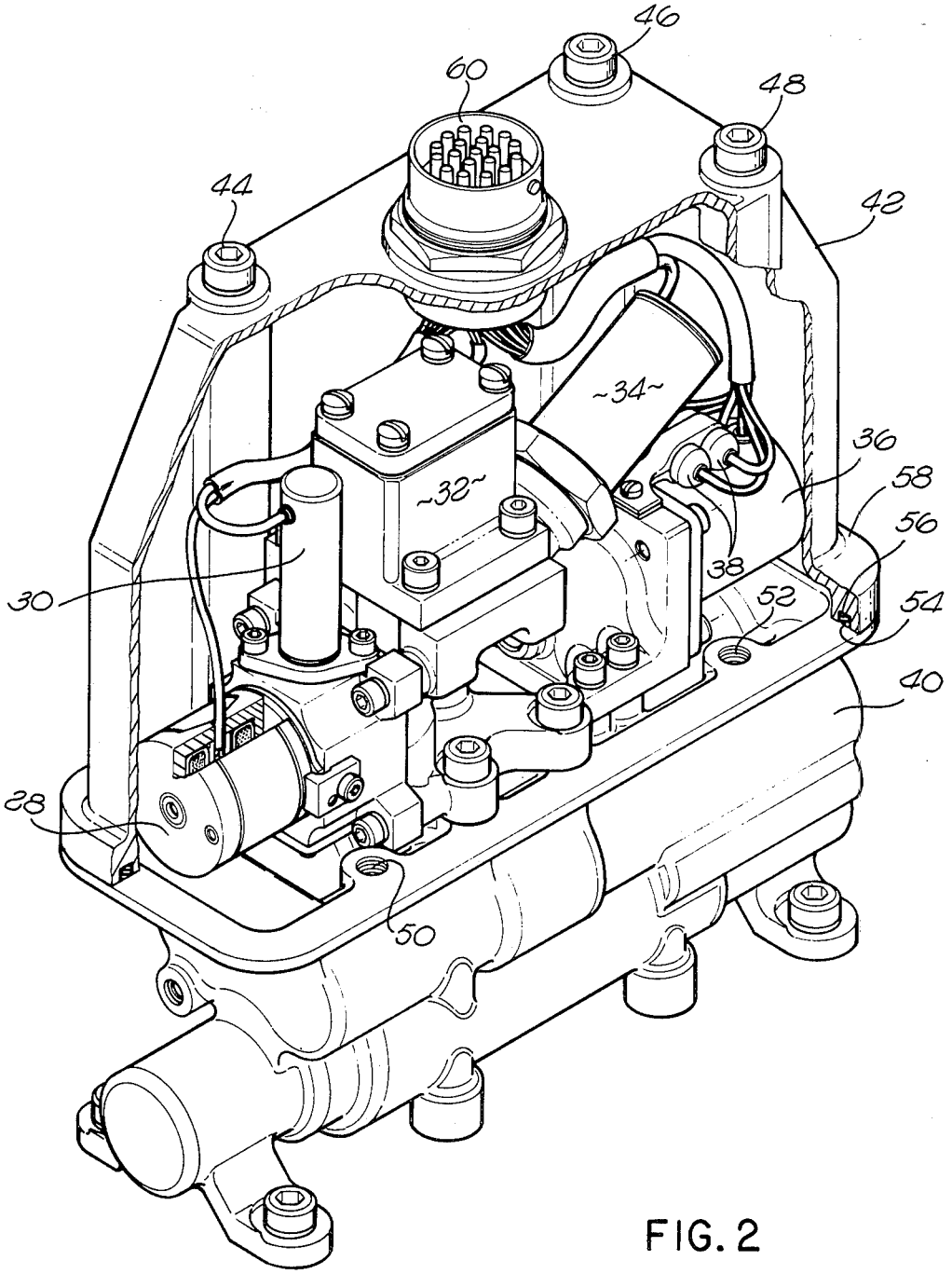
FIG. 2 is a perspective view, partly in cross-section, of a single modular electrohydraulic control device having the electronics section thereof removed to better illustrate placement of various parts.

By reference now to FIG. 2 the various other components of the MECA are illustrated with frame 26 removed for purposes of clarity. As is therein shown an electrohydraulic servovalve 28 includes a linear variable differential transformer (LVDT) affixed to the second stage thereof to provide position information. A differential pressure transducer 32 is provided to measure the pressure differences in the actuator cylinder chambers and the hydraulic lines and passageways connected thereto. A pressure switch 34 is provided to indicate whether hydraulic fluid under pressure is being provided to the system while a solenoid valve 36 controls application of pressure to the MECA. Suppression diodes 38 are provided to eliminate difficulties usually encountered from the voltage surges in the solenoid coil upon removal of the energizing potential therefrom. Thus components are all mounted directly or indirectly upon the housing member 40. The cover 42 is attached to the housing member 40 by bolts such as shown at 44, 46 and 48 which are threaded into threaded openings in the housing member such as shown at 50 and 52. A seal means 54 is held in place within a recess 56 in the lip 58 of the cover 42 and is used to sealingly secure the cover 42 to the housing member 40. An electrical connector 60 of a type well known to the art is secured to the cover 42 and various electrical wires are gathered from the components and terminate at the connector 60 internally of the cover 42.

Through the utilization of a MECA as illustrated in FIGS. 1 and 2, there is provided an unexpected and synergistic result. By utilization of the MECA, the manufacturer is capable of standardizing control equipment which will increase reliability, decrease maintenance, reduce design and development costs, but yet at the same time permit the customer to have his particular control module tailored to fit his specific design requirements so long as he stays within the capabilities of the MECA. Such capability has not heretofore been available in the electrohydraulic control arts and it is not readily apparent to those skilled in the art that by bringing together a multiplicity of control functions within a single housing member that such end results would be forthcoming.

Through the capability of standardization of the equipment involved for electrohydraulic control there is the obvious end result of lowering the costs of manufacturing each unit simply because a large number or units will be manufactured. However, with this standardization also goes extreme ease of maintenance of the equipment simply because the entire module is now a single unit with a plurality of functions previously performed by independent members all brought together in one housing. Approximately 90% of all malfunctions in electrohydraulic apparatus of the type herein under consideration occur within the functions performed in the single control module which is the subject matter of the present invention. As a result thereof, these malfunctions are now isolated to one single part and can be easily repaired by simply disconnecting a single MECA and replacing it with a new MECA. The removed and malfunctioning module can then be returned to an overhaul depot for appropriate maintenance operations thereon. Obviously, such capability lowers the down time of the apparatus to which the MECA is connected.

It should also be noted that since only one part, albeit a plurality of functions are performed thereby, is involved, increasing reliability both short term and long term result. This occurs simply because one now is dealing with a single element and a reliability factor can be developed therefor which can be utilized for all such parts used on various pieces of equipment.

Through the utilization of a modular electrohydraulic control apparatus in accordance with the present invention, a designer faced with the task of providing a control mechanism may now utilize the typical design manual approach available in other areas but not heretofore available in the hydraulic control system arts. That is, through the utilization of a MECA constructed in accordance with the present invention, the designer need only select those particular functions which he desires to have for his particular solution to his design problem. No engineering design and development effort need be expended other than reference to a design manual and specification of the particular functions desired. Obviously, such an approach drastically reduces the typical non-recurring engineering costs normally involved in providing electrohydraulic control apparatus.

Figure 3:
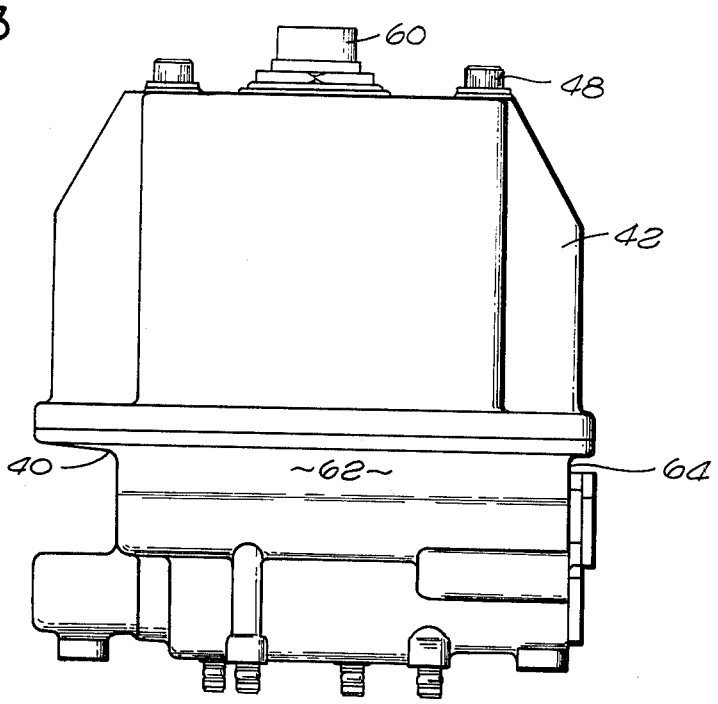
FIG. 3 is a side elevational view illustrating a modular electrohydraulic control apparatus constructed in accordance with the principles of the present invention.
Figure 4:
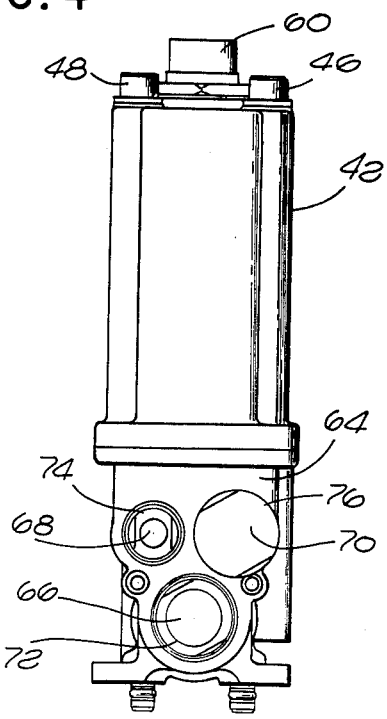
FIG. 4 is a side elevational view of the structure shown in FIG. 3.
Figure 5:
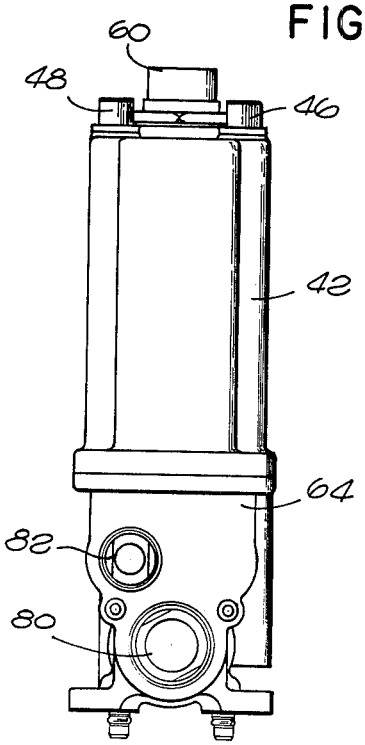
FIG. 5 illustrates a device similar to that shown in FIG. 4 but with only a portion of the bores capable of being defined by the housing provided therein.

Referring now to FIGS. 3 through 5, it will be noted that the unitary housing member 40 is a single cast solid block of metal. The block defines a body portion 62 which has a face 64. The bores 66, 68 and 70 are formed by the usual machine operations on the body causing the bores to enter from the face 64 into the body 62. Additional machining operations will necessarily be performed upon the housing 40 to provide passageways therein for intercommunication between the bores 66, 68 and 70 and for communication with the various components 28, 32, 34 and 36 as well as to provide access to hydraulic fluid under pressure and to provide flow of hydraulic fluid under pressure from the MECA to a load to be manipulated thereby.

The various machining operations to provide the bores and the passageways are well known to those skilled in the art and will not be described herein. Furthermore, it is not believed necessary to illustrate in detail the passageways within the body 62 to provide the communication with the various bores and components. Obviously, such passageways will vary depending upon the particular function to be performed by the valve received within the bores 66, 68 and 70 as will become more clear hereinbelow.

A cover plate 72, 74 and 76 is provided to sealingly cover the openings to the bores 66, 68 and 70, respectively, and each cover plate is threadably held in place on the body 62. Obviously, a single cover plate secured to the body 62 may be used if desired.

As is shown in FIG. 5, the body 62 may be provided with any number of bores desired depending upon the design considerations of the user. For example, as is shown in FIG. 5, only two bores 80 and 82 are provided whereas with reference to FIG. 4, it is noted that three bores 66, 68 and 70 are provided. Thus, a hypothetical customer utilizing the control module of FIG. 4 has selected functions differently from the customer choosing the apparatus as illustrated in FIG. 5.

By reference to FIG. 6 there is illustrated a bottom view of the housing 40 and shows the particular pattern which is required for mounting the electrohydraulic control module upon a particular structure such as the actuator 14 (FIG. 1). As is noted there is provided a plurality of mounting holes 90 through 96 by which the entire control module is secured in place with appropriate bolts or the like. Passageways are provided as illustrated at 98 and 100 for connection to a source of fluid under pressure and its return respectively. In addition, passageways 102 and 104 are provided to supply hydraulic fluid under pressure from the control module to a load apparatus to be controlled or moved by the flow of hydraulic fluid, properly controlled by the MECA, to an appropriate load such as a control surface on aircraft.

As will be now recognized each of the bores 66, 68 and 70 provided in the body 64 is adapted to receive a slidable valve member therein which is capable of providing a particular control or monitoring function that may be desired in specific applications to which the MECA may be put. For example, the pressure appearing across the piston in the actuator may be monitored and if excessive a relief or bypass automatically provided therefor.

By reference now to FIG. 7, there is illustrated a particular MECA hydraulic schematic diagram. The specific apparatus for which the schematic diagram of FIG. 7 is shown has been selected with the assumption that the user desired to include an electrohydraulic servovalve to provide control of an actuator which in turn is connected to an aircraft control surface. The servovalve would receive signals from the pilot and from the various augmentation systems within the aircraft. It is also presumed that feedback signal information is desired from the second stage of the servovalve as well as from the two passageways providing fluid under pressure to the actuator. In the event of extreme pressure build-up in the actuator, it is also assumed that a cylinder relief valve is desired. In addition thereto, it is also presumed that a shut-off and by-pass valve is required so that in the event of a malfunction in the control system the solenoid valve can be caused to shut off the supply of hydraulic fluid under pressure to the system. It will become obvious to those skilled in the art from a consideration of the hydraulic schematic diagram as shown in FIG. 7 that the shut-off and by-pass valve, the anticavitation valves, and the cylinder relief valve are all hydraulically actuated slide-valve members and that each of these is individually slidably disposed within one of the bores 66, 68 and 70 as illustrated in FIG. 4. In FIG. 7 the differential pressure indicator is illustrated in block form and may be a strain gauge type device. However, a slide valve type of device with an LVDT feedback may be inserted within an appropriate bore in the body. The hydraulic schematic diagram as illustrated in FIG. 7 is shown in shut-off position, that is with the solenoid valve deactivated in such a manner that the fluid under pressure from the hydraulic source P is not supplied to the circuit but rather is blocked by the shut-off valve. If the solenoid valve were energized, then the fluid under pressure would be allowed to pass through the solenoid valve and to the right side of the shut-off valve as shown in FIG. 7 causing it to move toward the left thus isolating the ports C-1 and C-2 from each other and permitting the flow of fluid from the servovalve to the ports C-1 and C-2 in accordance with the appropriate control information.

Since the various functions of the shut-off and bypass valve, the cylinder relief valves, the anticavitation valves and the differential pressure transducer are well known to those skilled in the art as are the functions and operation of the electrical hydraulic servovalve and the solenoid valve, it is not believed necessary to provide a detailed description thereof herein. Such is thought to be the case particularly since applicants' invention is not directed to the specific elements as shown in the hydraulic schematic of FIG. 7, but rather is directed to the modular electrohydraulic control apparatus (MECA) which may house within a single module any number of different types of valve members depending upon the particular function to be performed.

What is claimed is:

1. Modular electrohydraulic control apparatus for removable connection to a structure to be controlled comprising:

(A) a unitary housing member;

(B) at least one electrohydraulic servo-valve member component affixed to said unitary housing member;

(C) said housing member defining a plurality of bores therein each extending from one side only of said housing;

(D) cover plate means removably secured to said housing to sealingly cover said bores;

(E) at least one hydraulically actuated slide valve member component slidably disposed within each of said plurality of bores;

(F) a plurality of fluid passageways defined within said housing member for interconnecting each of said components received within said housing to selected ones of other of said components;

(G) said housing defining ports therein for receiving pressure and return connections from a source of hydraulic fluid under pressure and for connecting working fluid to said structure to be controlled;

(H) a protective cover;

(I) means sealing said protective cover to said housing member thereby to cover and provide protection for said electrohydraulic servo-valve; and (J) means for connecting said housing member to said structure to be controlled.

2. Modular electrohydraulic control apparatus as defined in claim 1 wherein said ports are the only external fluid connections to said housing and said components.

3. Modular electrohydraulic control apparatus as defined in claim 2 wherein said housing member includes a bottom surface defining four openings therein for said pressure, return and working parts.

4. Modular electrohydraulic control apparatus as defined in claim 1 which further includes electronic control circuit means and means mounting said electronic control circuit on said apparatus.

5. Modular electrohydraulic control apparatus as defined in claim 4 which further includes a connector means supported by said, cover electrical wiring means connected to said electrohydraulic servovalve member and said electronic control circuit means, said wiring coupled to said connector means, said connector means being the only electrical connection external of said modular appartus.

6. Modular electrohydraulic control apparatus as defined in claim 4 which further includes a frame member, means for removably attaching said frame member to said housing member, and means for attaching said electronic control circuit to said frame member.

7. Modular electrohydraulic control apparatus as defined in claim 1 which further includes provision in said housing for defining an additional bore therein for receiving an additional hydraulic component.

8. Modular electrohydraulic control apparatus as defined in claim 1 wherein said unitary housing member is a solid metal block having said bores and passageways formed therein.

* * * * *